US008083601B2

(12) United States Patent
Speedie

(10) Patent No.: US 8,083,601 B2
(45) Date of Patent: Dec. 27, 2011

(54) SYSTEMS AND METHODS FOR MOVING A BABY CONTAINER

(76) Inventor: Michael Alan Speedie, Scottsdale, AZ (US)

( * ) Notice: Subject to any disclaimer, the term of this patent is extended or adjusted under 35 U.S.C. 154(b) by 203 days.

(21) Appl. No.: 12/336,396

(22) Filed: Dec. 16, 2008

(65) Prior Publication Data

US 2009/0131185 A1 May 21, 2009

Related U.S. Application Data

(63) Continuation-in-part of application No. 10/970,588, filed on Oct. 20, 2004, now abandoned.

(51) Int. Cl.
*A63G 9/12* (2006.01)
*A63G 9/16* (2006.01)

(52) U.S. Cl. ..... 472/119; 472/135

(58) Field of Classification Search ..... 472/118–125, 472/135; 297/273, 274, 275; 5/108, 109, 5/127, 915
See application file for complete search history.

(56) References Cited

U.S. PATENT DOCUMENTS

| | | | | |
|---|---|---|---|---|
| 950,312 | A | 2/1910 | Vargas | |
| 1,420,134 | A * | 6/1922 | Hertha | 5/109 |
| 2,564,547 | A | 8/1951 | Schrougham | |
| 3,022,520 | A | 2/1962 | Finger | |
| 3,031,687 | A | 5/1962 | Stevens et al. | |
| 3,311,935 | A | 4/1967 | Petty | |
| 3,692,305 | A | 9/1972 | Allen | |
| 4,911,429 | A * | 3/1990 | Ogbu | 472/119 |
| 4,947,832 | A | 8/1990 | Blitzer | |
| 5,064,191 | A | 11/1991 | Johnson | |
| 5,097,545 | A | 3/1992 | Hooi | |
| D331,158 | S | 11/1992 | Hooi | |
| 5,342,113 | A | 8/1994 | Wu | |
| 5,376,053 | A | 12/1994 | Ponder et al. | |
| 5,615,428 | A | 4/1997 | Li | |
| 5,624,321 | A | 4/1997 | Snyder | |
| 5,695,432 | A | 12/1997 | Soderlund | |
| 6,024,648 | A | 2/2000 | Shurtleff et al. | |
| 6,343,994 | B1 | 2/2002 | Clarke | |
| 6,378,940 | B1 | 4/2002 | Longoria et al. | |

(Continued)

FOREIGN PATENT DOCUMENTS

AU 104758 8/1989

(Continued)

OTHER PUBLICATIONS

Webpage located at http://www.ambybaby.com/benefits-features.php.

*Primary Examiner* — Kien T Nguyen
(74) *Attorney, Agent, or Firm* — Tiffany & Bosco

(57) ABSTRACT

Systems and related methods are delineated for moving a provided baby container suspended above ground from a support structure. One delineated system for moving a provided baby container suspended above ground from a support structure, the system comprises: a force generator coupled to the baby container; an elastic supporter having a first end and a second end; a sound generation device proximate the force generator; wherein: the first end of the elastic supporter is coupled to the support structure; the second end of the elastic supporter is coupled to force generator; and the force generator is configured to apply a periodic force to the baby carrier to cause oscillatory motion; and the sound generation device is configured to provide an aural output when a predetermined condition is achieved. Audio/Video monitoring and transmission may be provided.

33 Claims, 7 Drawing Sheets

U.S. PATENT DOCUMENTS

| | | | | |
|---|---|---|---|---|
| 6,500,072 | B1 | 12/2002 | Myers et al. | |
| 6,689,075 | B2 | 2/2004 | West | |
| 7,234,177 | B1 * | 6/2007 | Drevitson et al. | 5/120 |

FOREIGN PATENT DOCUMENTS

| | | |
|---|---|---|
| AU | 114063 | 9/1991 |
| CA | 2078015 | 3/1993 |
| CH | 118509 | 7/1990 |
| CN | 1108915 | 9/1995 |
| DE | M9007140.9 | 6/1991 |
| GB | 2010646 | 11/1992 |
| IT | 022087 | 11/1990 |
| JP | 5115343 | 5/1993 |
| NZ | 23265 | 5/1990 |

* cited by examiner (t = 0)

(t = 1)

(t = 2)

(t = 3)

(t = 4)

SYSTEMS AND METHODS FOR MOVING A BABY CONTAINER

RELATED APPLICATIONS

This application is a continuation-in-part of U.S. application Ser. No. 10/970,588 filed Oct. 20, 2004 now abandoned which is incorporated fully herein for all purposes.

FIELD OF THE INVENTION

The present invention relates to systems and methods for relaxing babies, and more particularly, to systems and methods for moving a baby container to relax a baby.

BACKGROUND OF THE INVENTION

A variety of containers exist for supporting, containing and/or retaining a baby. As used herein, the term "container" means any structure suitable for supporting, containing and/or retaining a baby. As used herein, the term "baby" means a human child of any age, though typically under the age of five years. Thus, as used herein, the term "baby container" means any structure suitable for supporting, containing and/or retaining a human child of any age. For example, a baby container may comprise: (1) a baby basinet, (2) a baby bouncer seat, (3) a baby carriage, (4) a baby chair or seat for use in a vehicle, e.g., a car seat for a baby, (5) a baby cradle, (6) a baby crib, (7) a baby jumper, (8) a baby stroller, (9) a baby swing and/or (10) any other structure suitable for supporting, containing and/or retaining a baby.

Controlled movement of a baby container may have desirable effects on a baby in the baby container. For example, such desirable effects may include calming a baby that for any reason is not calm, e.g. due to any illness and/or any unfulfilled need, and/or helping a baby fall asleep. Accordingly, a wide variety of baby containers include moving mechanisms. However, none of the known baby containers provides, individually or collectively, a system for moving a baby container suspended above ground, as disclosed by the embodiments of the present invention.

SUMMARY OF THE INVENTION

In accordance with an embodiment of the invention, a system is disclosed for moving a provided baby container suspended above ground from a support structure, the system comprising: a force generator coupled to the baby container; an elastic supporter having a first end and a second end; a sound generation device proximate the force generator; wherein: the first end of the elastic supporter is coupled to the support structure; the second end of the elastic supporter is coupled to force generator; the force generator is configured to apply a periodic force to the baby carrier to cause oscillatory motion; and the sound generation device is configured to provide an aural output when a predetermined condition is achieved.

Another embodiment of the invention comprises a system for moving a provided baby container suspended above ground from a support structure, the system comprising: a force generator coupled to the baby container; an elastic supporter having a first end and a second end; a sound generation device proximate the force generator; a controller coupled to force generator; and wherein: the first end of the elastic supporter is coupled to the support structure; the second end of the elastic supporter is coupled to force generator; and the force generator is configured to apply a periodic force to the baby carrier to cause oscillatory motion; the sound generation device is configured to provide an aural output when a predetermined condition is achieved; wherein the controller comprises at least one of a, sensor, processor, display, intensity control, audio control, power inputs, user interface, light output, an audio input, a data interface, and a memory card interface; and wherein the sound generation device further comprises an alarm, speaker, calming noise, white noise, womb noise, heartbeat, motor noise, pre-recorded or recordable human voice, and music.

In accordance with yet another embodiment of the invention, a method is disclosed for moving a provided baby container suspended above ground from a support structure, the method comprising: a force generator coupled to the baby container; an elastic supporter having a first end and a second end; a sound generation device proximate the force generator; wherein: the first end of the elastic supporter is coupled to the support structure; the second end of the elastic supporter is coupled to force generator; and the force generator is configured to apply a periodic force to the baby carrier to cause oscillatory motion; and the sound generation device is configured to provide an aural output when a predetermined condition is achieved.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIGS. 3F and 3J are elevational views showing operation of the force generator of FIG. 2C, in accordance with systems and methods consistent with the present invention.

DESCRIPTION OF THE EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Figure 1C:
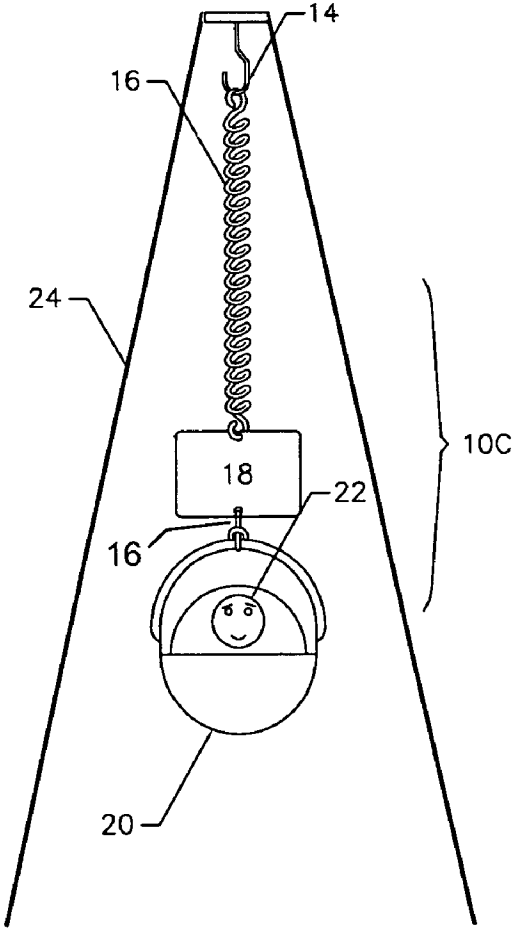
FIGS. 1A-1C and 1A'-1C' are elevational views of embodiments of a system for moving a baby container, in accordance with systems and methods consistent with the present invention.
Figure 1B:
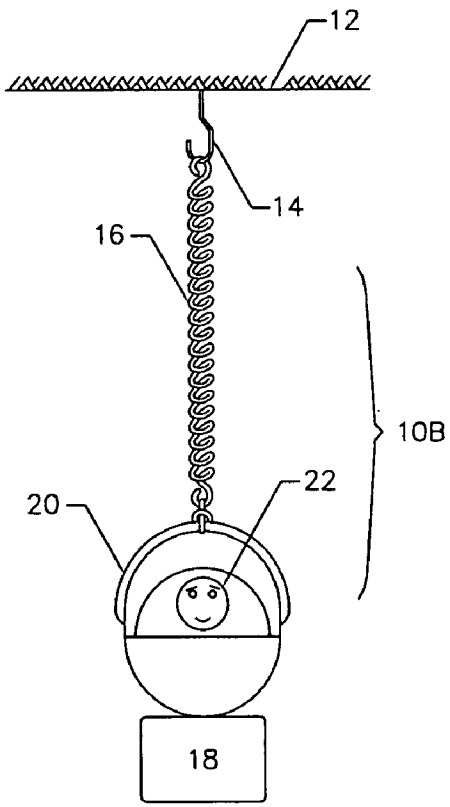
Figure 1A:
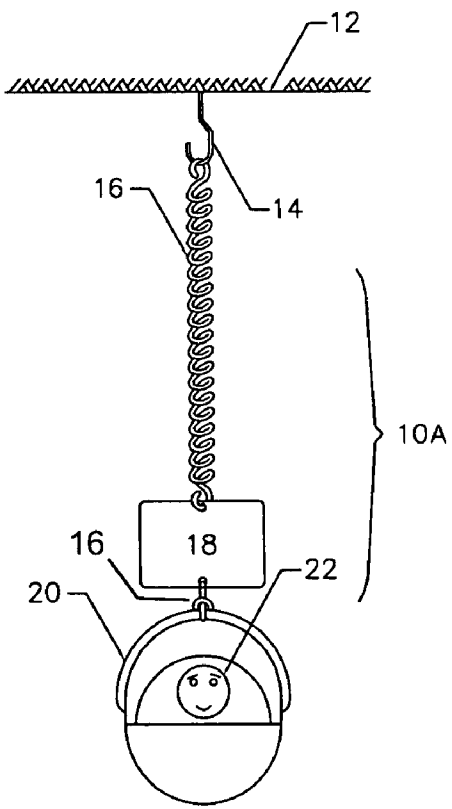
Figure 1C:
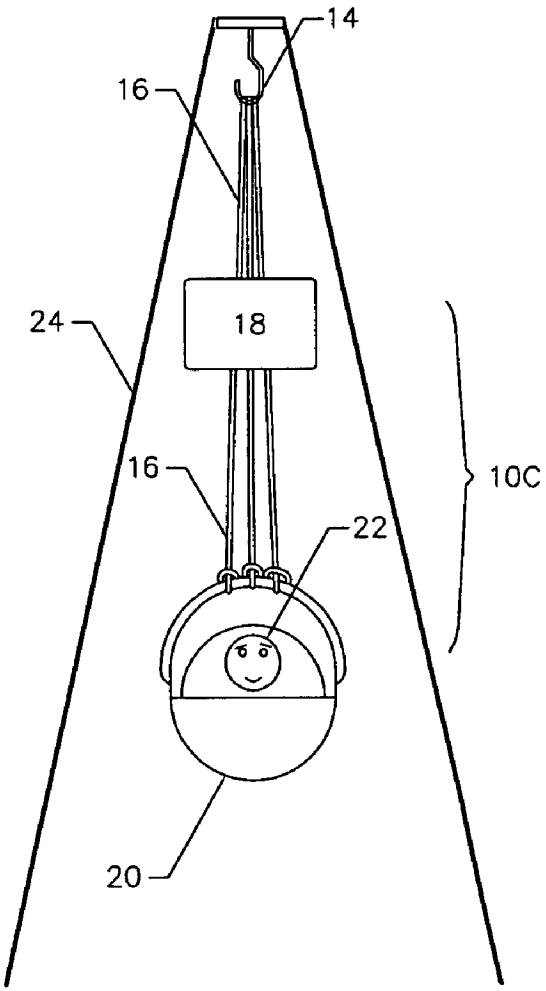
Figure 1B:
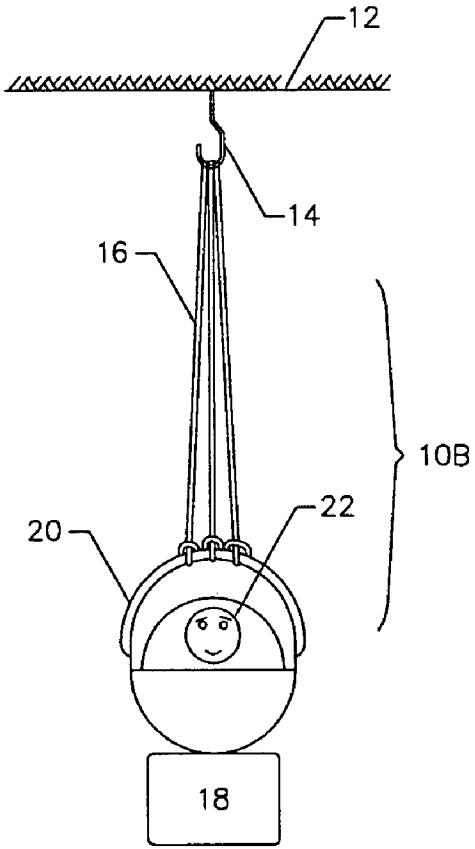
Figure 1A:
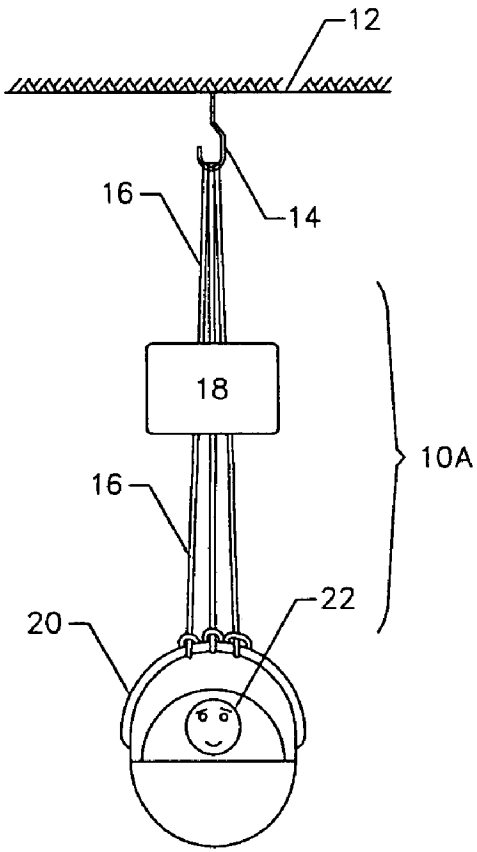

Referring to FIG. 1A, an embodiment is shown of a system 10A for moving a container 20 (and a baby 22) that may be suspended from a suspension point 14 above ground (hereafter, "container 20" is understood to contain baby 22). System 10A may include one or more elastic supporters 16 for suspending container 20 and a force generator 18 for providing oscillating force along the one or more elastic supporters 16.

Suspension point 14 may be provided by any connector suitable for suspending a desired load, including system 10A, such as a support structure. For example, suspension point 14 may comprise a hook, such as a Crawford SS18-250 threaded hook, securely anchored to an upper surface 12, as may be provided by one or more support members for a ceiling.

The one or more elastic supporters 16 may comprise one or more of any structure suitable for suspending container 20 above ground from suspension point 14 and permitting an up-and-down motion of container 20, without having container 20 hit the ground. For example, the one or more elastic supporters 16 may comprise one or more elastic lines, such as one or more springs, e.g., one or more metal springs of approximately 1-inch diameter, 14-inches long. These elastic supporters may be encased in a protective material to protect against injuries. This protective material may include, plastic sheathing, a cloth wrapping, a tubular encasement running the linear length of the elastic supporter, and or the like.

Assuming for purposes of illustration that the one or more elastic supporters 16 comprise one or more springs, hook-type fasteners are typically included on each end of the one or more springs for attaching the ends of each spring to one or more desired objects. Though hook-type fasteners are typically included on the ends of a spring, any means suitable for attaching the ends of one or more springs to one or more desired objects may be employed, including tying the ends of each spring to one or more desired objects. Moreover, it is not necessary to attach the ends of a spring to one or more desired objects, i.e., one or more attachment points may be provided anywhere along the length of a spring. Additionally, a secondary safety support may be added traveling inside of the spring connected from the suspension point 14 to the container 20 or force generator 18. This safety support shall be made of a material sufficiently strong to support the weight of all of the elements connect to the second end of the elastic supporter 16 including the container 20 and/or the force generator 18. It shall be slightly longer than the elastic supporters 16 longest desired length at full extension (deformation). Should the elastic supporter fail, the safety support shall hold the elements above the ground. The safety support may be an additional spring, bungee or span of other material.

Assuming for purposes of illustration that the one or more elastic supporters 16 comprise one or more springs with hook-type fasteners on each end, a hook-type fastener on one end of each spring may be attached to suspension point 14, while a hook-type fastener on the other end of each spring may be attached to container 20. Any means suitable for attaching force generator 18 to the one or more springs may be employed, e.g., a clamp attached to force generator 18 and clamped around one or more portions of the one or more springs. Additionally, safety locks may be added to prevent the elastic support from de-coupling from the support structure. This arrangement of attaching force generator 18 to the one or more springs presupposes that the one or more springs are attached to suspension point 14 and force generator 18. In a different arrangement, an upper group of one or more springs may be attached to suspension point 14 and force generator 18, while a lower group of one or more springs may be attached to force generator 18 and container 20. In the latter arrangement, one or more connection points may be provided on force generator 18 for attaching to both the upper and lower groups of one or more springs.

Force generator 18 may comprise any structure suitable for providing oscillating force along the one or more elastic supporters 16. The oscillating force may provide force in an alternating pattern up and down along the one or more elastic supporters 16, thereby causing container 20 to move in an up-and-down motion, substantially along an axis extending from suspension point 14 through the center of gravity of container 20 to the ground. Force generator 18 may include any means suitable for selectively controlling one or more parameters related to the oscillating force. Force generator 18 may comprise a hand wound gear train, piston, pendulum, motor, gears, pump and/or the like. Preferably, the force generator 18 is suspended from a suspension point 14 and hangs from one or more elastic supporters 16. In one embodiment, the force generator 18 is located between the suspension point 14 and the container 20. Though not depicted, the force generator 18 may be built into the container 20.

Alternatively, the force generator 18 may be supported from a support point with an elastic member disposed between and respectively coupled to the force generator 18 and baby carrier from below, as supported from the floor. Additional struts may be added to this embodiment to further stabilize the system.

For example, force generator 18 may include one or more user-adjustable inputs to one or more controllers 50, e.g. dials providing one or more inputs to one or more controllers 50, for selectively controlling the amplitude, frequency, timing period and/or phase of the oscillating force. Using such means for selectively controlling one or more parameters related to the oscillating force, a user may control one or more parameters related to the displacement of container 20. For example, a user may adjust one or more inputs to force generator 18 to control the distance traversed in a full cycle of the up-and-down motion of container 20 and/or the speed of travel for container 20. A full cycle of the up-and-down motion of container 20 may comprise a travel distance of anywhere in the range of approximately one to forty inches, inclusively. When force generator 18 does not include means for selectively controlling one or more parameters related to the oscillating force, force generator 18 may be preset to provide a predefined oscillating force. Force generator 18 may induce a resonant characteristic of the elastic support coupled to the force generator resulting in a sinusoidal vertical displacement and/or periodic motion of the container 20.

Referring to FIG. 1B, an alternative embodiment is shown of a system 10B for moving container 20 that may be suspended from suspension point 14 above ground. System 10B is identical to system 10A, except that force generator 18 may be attached below container 20 using any suitable means for attachment.

Referring to FIG. 1C, an alternative embodiment is shown of a system 10C for moving container 20 that may be suspended from suspension point 14 above ground. System 10C is identical to system 10A, except that suspension point 14 is provided by a support structure 24, i.e., any support structure that is (1) suitable for holding a predefined load, including container 20 and force generator 18 and (2) does not include part of a building structure, e.g., a house. Additionally, system 10C may attach force generator 18 below container 20, as in system 10B.

FIGS. 1A', 1B' and 1C' are alternative embodiments of systems 10A, 10B and 10C for moving a container 20. The elastic supporters may be any material designed to be deformed, such as a leaf spring, coil spring, an elastomer, bungee cord, or purposefully deformed object. The elastic supporters of systems 10A, 10B, and 10C as depicted in FIGS. 1A', 1B' and 1C' comprise bungee cords, e.g., one or more Blue Ridge bungee cords available from Mavin-Quill & Company of Clarington, Pa. The container 20 shown in FIGS. 1A' and 1C' or systems 10A and 10C may be coupled to the force generator 18 with no elastic supporter 16 in-between (similar to the embodiments shown in systems 10A and 10C as shown in FIGS. 1A and 1C) or the force generator 18 may be located between a suspension point 14 and the container 20 coupled with a plurality of elastic supporters.

Figure 2A:
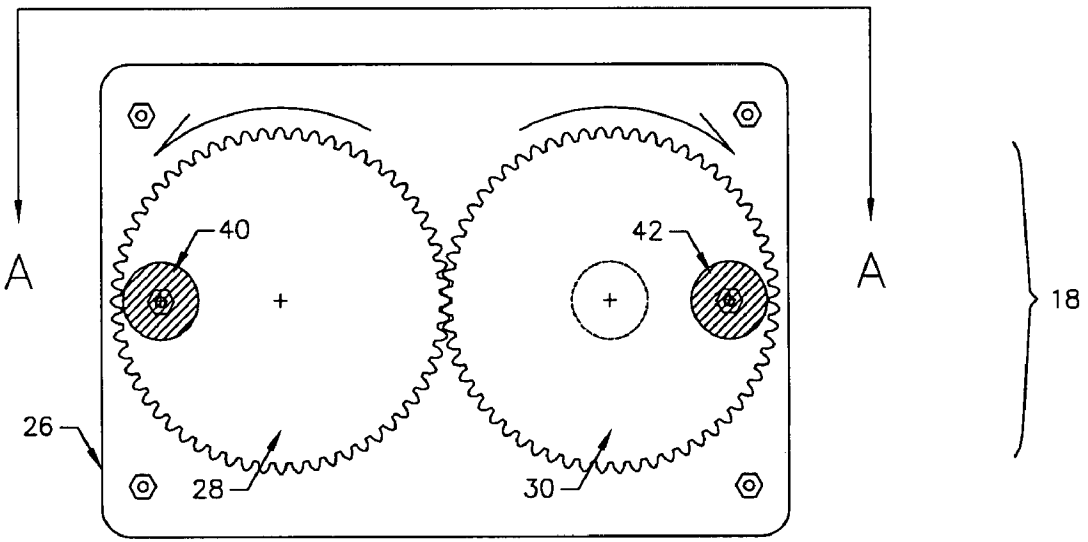
FIG. 2A is an elevational view of a force generator configured to move a baby container, in accordance with systems and methods consistent with the present invention.
Figure 2B:
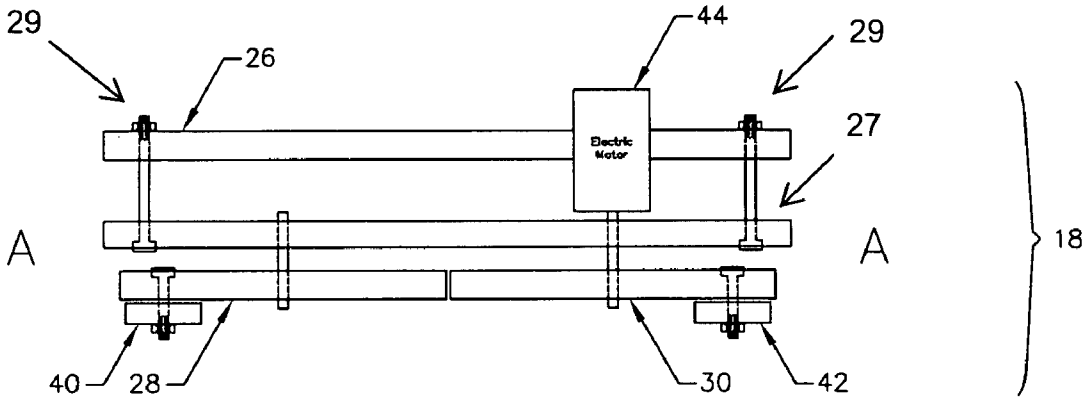
FIG. 2B is a plan view of a force generator, taken from the line A-A of FIG. 2A, in accordance with systems and methods consistent with the present invention.

FIGS. 2A and 2B show an embodiment of force generator 18 for providing oscillating force along the one or more elastic supporters 16, as shown in FIGS. 1A-1C and 1A'-C'. In FIGS. 2A and 2B, portions of a housing 26 are removed to show that this embodiment of force generator 18 may include one or more motors 44 and a plurality of gears 28-30 of a diameter, e.g., five inches. Force generator 18 may be enclosed by housing 26, which has portions removed in FIGS. 2A and 2B to show the inner portions of force generator 18. As shown in FIG. 2B, housing 26 may include a support member 27 and connectors 29, as well as any other structure suitable for housing force generator 18. The one or more motors 44 may comprise one or more of any motor suitable to rotate the plurality of gears 28-30, as further described below. Moreover, the one or more motors 44 may be powered by battery and/or an external electrical source and may be suitably lightweight.

The plurality of gears 28-30 may be constructed of any suitably strong, durable and lightweight material, such as a plastic. As shown in FIG. 2A, the plurality of gears 28-30 may be coplanar. An electric motor 44, e.g., a Zhengke 12V DC 60 RPM gear motor, model ZGB37RG58i, which may be powered by a source that may provide approximately 50 to 1000 mili-amperes, may be coupled to gear 30, to rotate the plurality of gears 28-30, as indicated by the arrows in FIG. 2A, which may include rotating gears 28 and 30 in opposite directions. The one or more motors 44 and the plurality of gears 28-30 may be selected such that when force generator 18 operates, gears 28 and 30 may each complete one revolution within a period of time in the range of approximately one-half second to approximately ten seconds.

Gears 28 and 30 may include weighted portions 40 and 42, which may be of approximately equal weight, such as a weight in the range of 0.01 pounds to 2.5 pounds, or more. Weighted portion 40 may comprise any material that may create a localized or concentrated region of weight on gear 28 at weighted portion 40. Similarly, weighted portion 42 may comprise any material that may create a localized or concentrated region of weight on gear 30 at weighted portion 42. For example, weighted portions 40 and 42 may comprise a metal, a dense rubber or composite, or any other material that may create a localized or concentrated region of weight on their respective gears 28 and 30. Weighted portions 40 and 42 may be coupled to their respective gears 28 and 30 during and/or after fabrication of gears 28 and 30. Weighted portions 40 and 42 may be fixedly coupled to their respective gears 28 and 30, or be removable, such that weighted portions 40 and 42 may be adjustable. For example, weighted portions 40 and 42 may be removable and replaceable by a user, who wishes to insert for each weighted portion 40 and 42 a different weight (although both weighted portions 40 and 42 are typically the same approximate weight) to achieve desired operational characteristics for one or more of systems 10A-10C and 10A'-10C'.

Figure 3A:
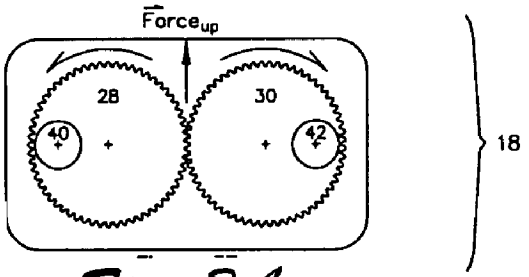
FIGS. 3A-3E are elevational views showing operation of the force generator of FIG. 2A, in accordance with systems and methods consistent with the present invention.
Figure 3B:
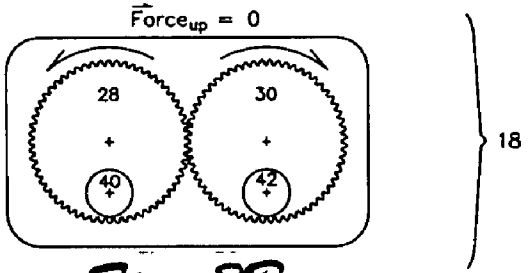
Figure 3C:
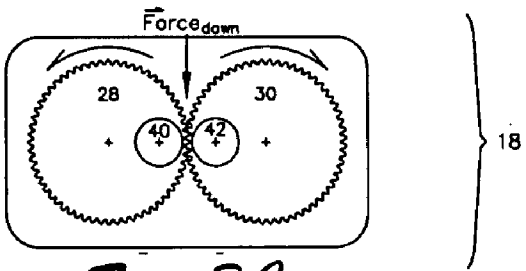
Figure 3D:
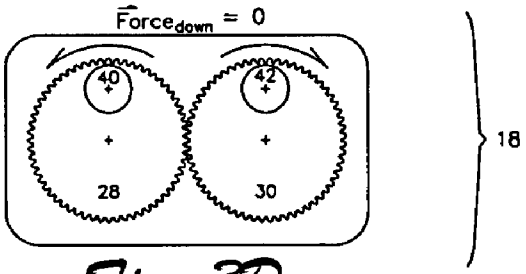

The one or more motors 44 and plurality of gears 28-30 may operate to rotate gears 28 and 30 and their respective weighted portions 40 and 42, as shown in FIGS. 3A-3E, which depict one complete rotation of gears 28 and 30 and their respective weighted portions 40 and 42. FIGS. 3B and 3D show weighted portions 40 and 42 "in phase," meaning that for a given moment in time, weighted portions 40 and 42 are located at approximately the same relative position on their respective travel paths. For example, as shown in FIG. 3B, both weighted portions 40 and 42 are located at approximately the same relative position on their respective travel paths, e.g., on the bottom of their respective travel paths on gears 28 and 30. Similarly, as shown in FIG. 3D, both weighted portions 40 and 42 are located at approximately the same relative position on their respective travel paths, e.g., on the top of their respective travel paths on gears 28 and 30. At all other times during rotation of gears 28 and 30, weighted portions 40 and 42 may be "out of phase," meaning that for a given moment in time, weighted portions 40 and 42 are not located at approximately the same relative position on their respective travel paths.

Figure 3E:
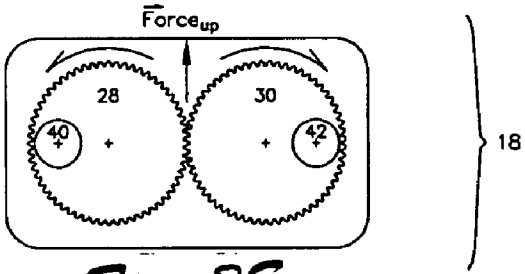
Figure 37:
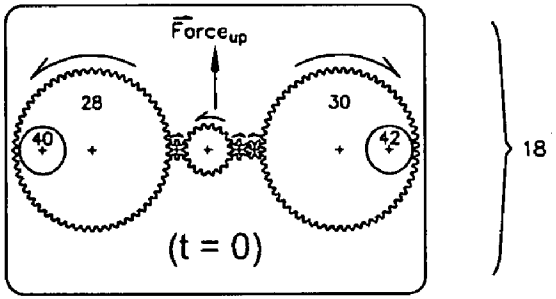
Figure 36:
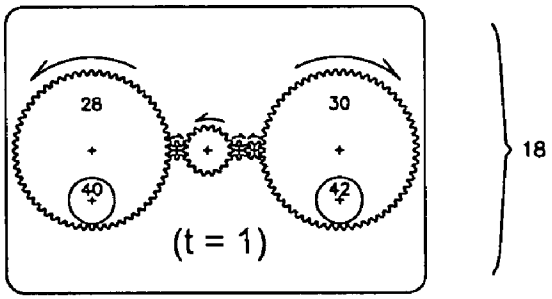
Figure 34:
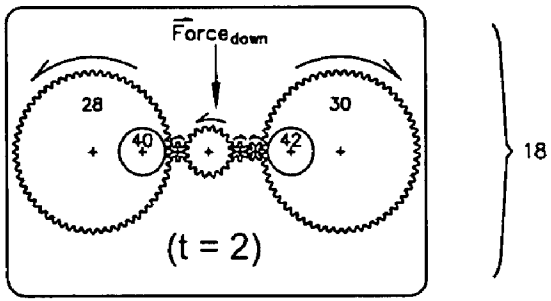
Figure 39:
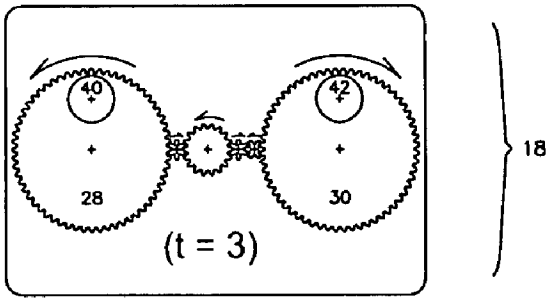
Figure 38:
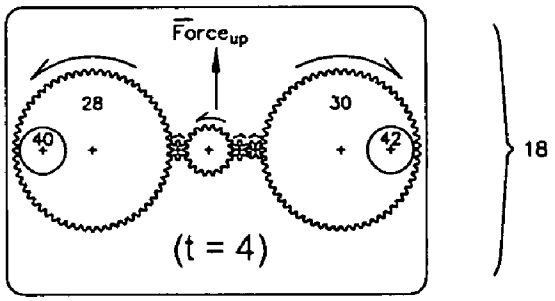

When weighted portions 40 and 42 are approximately equal in weight and rotated in opposite directions with the phase arrangement shown in FIGS. 3A-3E, lateral force, i.e., force that is not substantially along the one or more supporters 16, that may be generated due to rotation of weighted portion 40 may cancel opposing lateral force that may be generated due to rotation of weighted portion 42. Thus, when weighted portions 40 and 42 are approximately equal in weight and rotated in opposite directions with the phase arrangement shown in FIGS. 3A-3E, the net lateral force may be negligible and force generator 18 may provide the oscillating force, namely upward and downward forces (respectively "$F_{up}$" and "$F_{down}$"), as shown in FIGS. 3A, 3C and 3E, substantially along the one or more supporters 16. An imaginary line extending from the top position of weighted portion 40, as shown in FIG. 3D, to the bottom position of weighted portion 40, as shown in FIG. 3B, may be substantially parallel to a vector for the oscillating force, e.g., $F_{up}$ and/or $F_{down}$. Similarly, an imaginary line extending from the top position of weighted portion 42, as shown in FIG. 3D, to the bottom position of weighted portion 42, as shown in FIG. 3B, may be substantially parallel to a vector for the oscillating force, e.g., $F_{up}$ and/or $F_{down}$.

Additional weights may be added or removed in order to control the speed of the motion and alter the resonant frequency of the system. Adding weight may be performed manually by a person or automatically by the controller.

Further, weight or weights may be added to or incorporated into the force generator 18 housing to insure the unit is balanced and delivers a steady motion to the container 20.

Figure 2C:
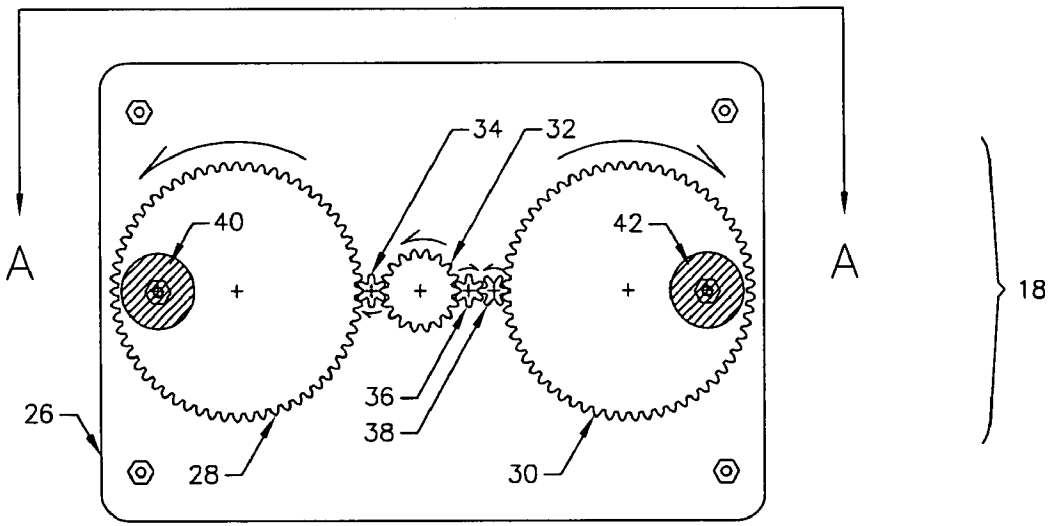
FIG. 2C is an elevational view of another force generator for moving a baby container, in accordance with systems and methods consistent with the present invention.
Figure 2D:
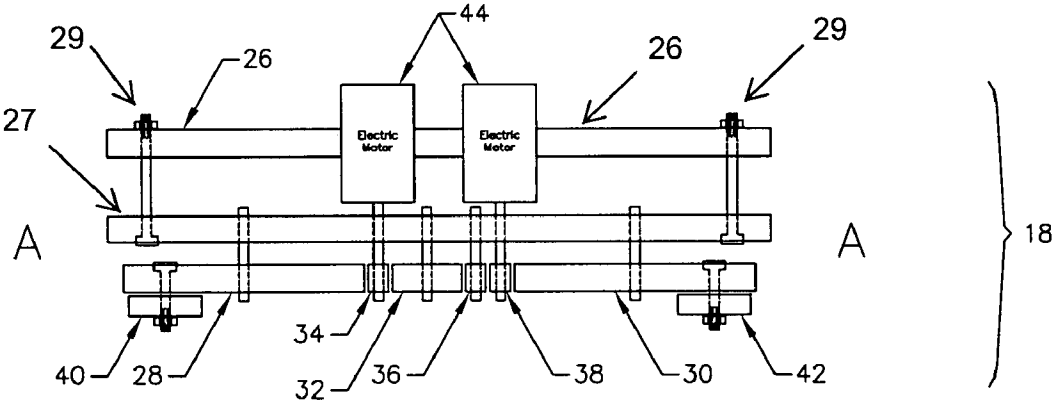
FIG. 2D is a plan view of a force generator, taken from the line A-A of FIG. 2C, in accordance with systems and methods consistent with the present invention.

FIGS. 2C and 2D depict an alternative embodiment of force generator 18 for providing oscillating force along the one or more elastic supporters 16, as shown in FIGS. 1A-1C and 1A'-1C'. It is essentially the same as the force generator 18 depicted in FIGS. 2A and 2B with the addition of intermediary gears 32, 34, 36, and 38. This embodiment employs a plurality of motors 44 to drive gears 34 and 38. Alternatively, one could envision force generator 18 employing gears 28 and 30 (with their respective weighted portions 40 and 42) directly driven by a respective motor 44, thus eliminating gears 32-38. Or, in a variation of the embodiment of force generator 18 depicted in FIGS. 2C and 2D, one could employ one motor 44 coupled to gears 28 or 32, or to any number of intermediary gears, or a single motor coupled to one of any number of intermediary gears to obtain the desired frequency.

Referring to FIGS. 3A-3J, the displacement of force generator 18 may be along an axis that may be substantially along the one or more supporters 16. FIGS. 3A through 3E correspond to the force generator 18 depicted in FIGS. 2A and 2B. FIGS. 3F through 3J correspond to the force generator 18 depicted in FIGS. 2C and 2D. In FIGS. 3A and 3F, force generator 18 may be located between a maximum upward position and a maximum downward position, e.g., approximately half way between the two maximums, and may generate an upward force $F_{up}$ substantially along the one or more supporters 16. In FIGS. 3A and 3F, force generator 18 may be located along its vertical displacement track at a maximum upward position and may generate a net force substantially along the one or more supporters 16 that may be negligible. In FIGS. 3C and 3H, force generator 18 may be located between a maximum upward position and a maximum downward position, e.g., approximately half way between the two maximums, and may generate a downward force $F_{down}$ substantially along the one or more supporters 16. In FIGS. 3D and 3I, force generator 18 may be located along its vertical displacement track at a maximum downward position and may generate a net force substantially along the one or more supporters 16 that may be negligible. In FIGS. 3E and 3J, force generator 18 may be located between a maximum upward position and a maximum downward position, e.g., approximately half way between the two maximums, and may generate an upward force $F_{up}$ substantially along the one or more supporters 16.

Force generator 18, for example, may comprise any structure that is a variation of the embodiment of force generator 18 depicted in FIGS. 2A and 2B or a completely different type of force generator 18, such as a mass coupled to a driver, as long as it may provide oscillating force along the one or more elastic supporters 16. Thus, in a variation of the embodiment of force generator 18 depicted in FIGS. 2A and 2B, one could employ two or more motors 44 coupled to gears 28 and 32, or to any number of intermediary gears, or a single motor coupled to one of any number of intermediary gears to obtain the desired frequency.

Figure 4:
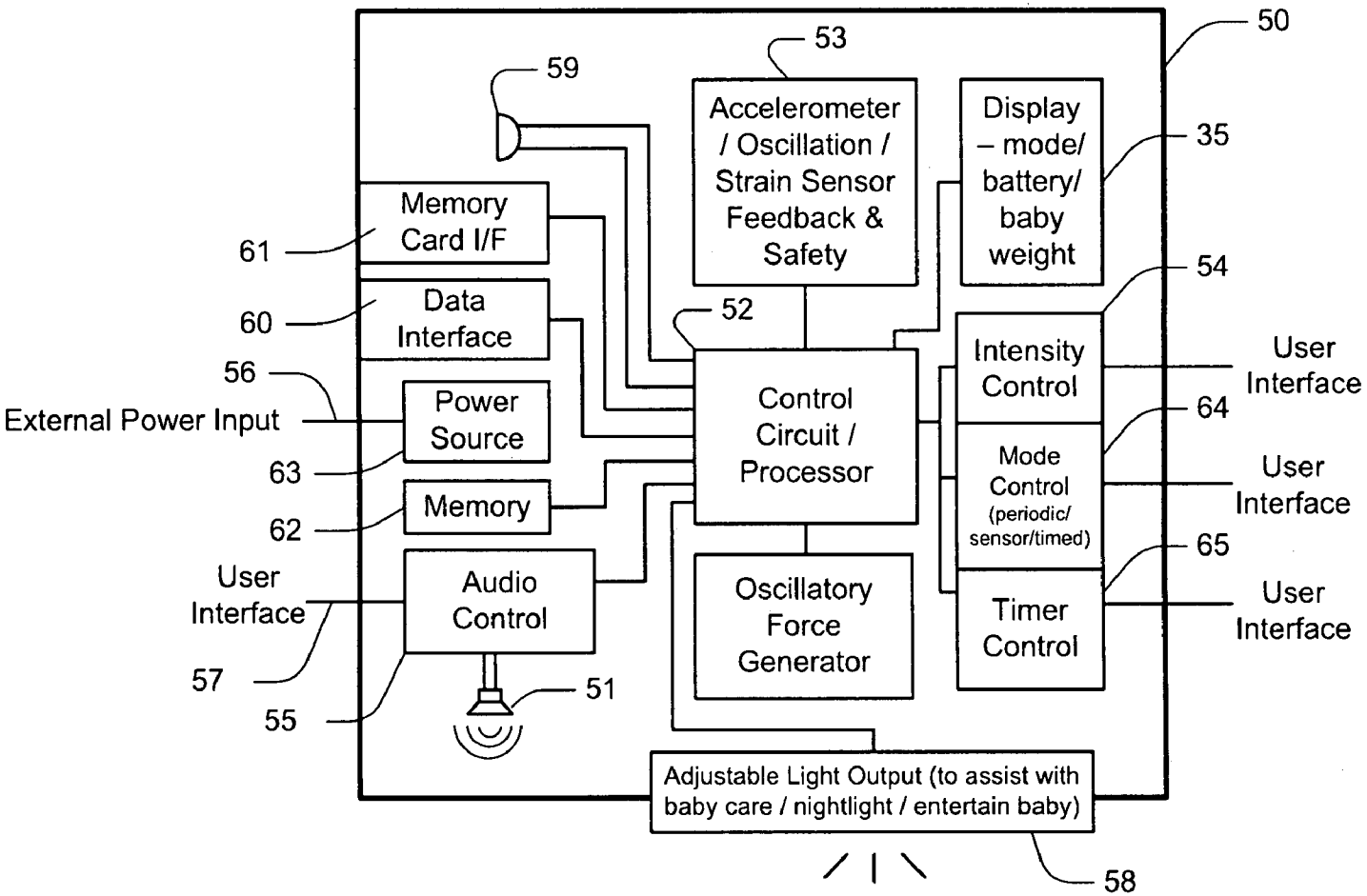
FIG. 4 is a block diagram of a controller in accordance with systems and methods consistent with the present invention.

Referring to FIG. 4, in accordance with each of the described embodiments of the present invention, the force generator 18 is controlled by and in communication with a controller 50. The controller 50 may include a processor 52, which is configured to interpret instructions and execute programs stored in a memory 62. The controller 50 may further comprise a sensor 53, display 35, intensity control 54, audio control 55, external power input 56, user interface 57, light output 58, an audio input 59, audio output 51, a data interface 60, and a memory card interface 61. The controller 50 may execute one of a plurality of programs that control or may modify operation parameters of any desired aspect of control for the force generator 18, such as the force, the speed, timing, the period, and the intensity of the motion. The processor 52 of the controller 50 may comprise a microcontroller or a microprocessor that may execute a set of instructions in accordance with a firmware or software program. The controller 50 may also measure the users' use of the system. For instance, a countdown clock may end a signal to the controller 50 to slow the motion and ultimately stop the motion after a specified time period.

The controller 50 may include memory 62 that may store the measurements and indicia of the program or programs being used. This memory may be read only memory or for purposes of the present application, a read only memory (also known as a "ROM") includes not only non-modifiable memories such as mask ROMs and one-time programmable PROMs, but also persistent memories that may not be directly or indirectly modified through the user interface of a controller 50. Such persistent memories may include such storage devices such as field programmable ROMs, EPROMs, EEPROMs, FLASH memory, and accompanying input or output ports. The measurements and indicia may be transferred to other systems, such as a hard drive, memory card interface, a network of computers, or may be printed out via a printer or displayed on a monitor or screen on a display 35. The memory card interface may include any number of electrical and mechanical interfaces to accommodate a solid-state flash memory data storage device (such as a PC card, a PCMCIA card, a CompactFlash card, memory stick, miniSD card, microSD card, MMCmicro card, Secure Digital Card, a memory stick, a FLASH drive, and SIM card. Data transfer may occur through hardwire connection such as the data interface 60, removable memory, or wireless data transfer, for instance a controller 50 may be coupled to a computer through a USB cable and upload or download measurements and indicia through a processor. The data interface 60 may comprise a wired or wireless interface between the controller and other computers and peripheral devices comprising at least one of USB port, ethernet port, serial port, parallel port, IEEE 1394 interface, wireless antenna, Wi-Fi, mini-DIN connector, D-sub 15, DVI, RCA connectors and transceiver microchips such as used in Bluetooth protocol. The controller 50 may be coupled to a computer system or network such as the Internet so that it is accessible by a user using the computer or Internet. In the alternative, the controller 50 may receive signals remotely such as using a remote control or instructions delivered via the internet to provide control of the force generator 18, i.e., it may send signals to control the controller 50. One embodiment of remote use includes coupling to a baby monitor. In another embodiment, preloaded audio or visual stimulation may be downloaded from a website or uploaded from a memory, such as a FLASH memory. This program may coordinate the movement, audio and/or visual stimulation of the system.

The display 35 may be any suitable display for conveying information to a user or entertain the baby. These may include at least one of: reference markings, colored lights, computer monitor, remote (handheld) device, electroluminescent displays (ELDS), light emitting diode (LED), liquid crystal display (LCD) (positive or negative) such as twisted nematic (TN) and supertwisted nematic (STN) double and triple twisted nematic (DSTN and TSTN) displays and the active-matrix thin-film twisted nematic and metal-insulated-metal twisted nematic (TFT-TN and MIM-TN) displays and or the like. The interface of the display 35 may be any suitable interface for the input and output of information. It may include a command line interface, static picture, video, flashing or moving lights, graphical display, auditory, touch screen, push button, sliding bar, switch, control knob, and or the like.

The controller 50 may contain sensors 53. The sensors 53 may also comprise a movement or oscillation detection device to detect the distance traveled by the container 20 such as a linear variable differential transformer, (LVDT), potentiometer, tilt switch, pressure switch, strain gauge, material motion detector and/or the like. In one embodiment, a potentiometer may accept mechanical control from a user to adjust any aspect of operation of embodiments of the present invention such as amplitude of oscillation. Alternatively, an accelerometer may be implemented to measure and adjust the motion of the force generator 18 and/or the container 20 to achieve a desired result such as a desired deflection or amplitude of oscillation of the baby carrier when the force generator is in operation. An accelerometer is a device for measuring acceleration and gravity induced reaction forces. Single and multi-axis models are available to detect magnitude and direction of the acceleration as a vector quantity. Accelerometers can be used to sense inclination, vibration, and shock. A strain gauge may be implemented in the alternative to measure forces induced by the oscillation or to indicate wear or as a safety measure. Strain gauges are sensing devices that change resistance at their output terminals when stretched or compressed. The sensors 53 may also be used to measure and send indicia of a baby's weight to the display 35 and/or memory. In an embodiment, the sensors may measure the amplitude, frequency and/or phase of the motion of the baby carrier 20 so that the oscillating force applied by the force generator may be appropriately adjusted to obtain a desirable result such as a particular amplitude of oscillation. The controller may include a video camera and may be capable of storing and transmitting still photos or real-time audio/video of the baby. The transmitted audio/video may be an over-the-air transmission, a web cam transmission, or other method.

The audio input 59 may further comprise any device capable of receiving an audio input, such as a microphone. This microphone may be used for recoding messages or to take audio direction as in voice or command recognition or as a cry sensor. For instance, a user saying, "STOP" may cause the controller 50 to send signals to stop movement of the force generator 18. Alternatively, a parent may prerecord soothing words or sounds for playback to an audio output while the system is in use. In addition the processor 52 may be configured to execute instructions from memory to detect a condition when an audio signal received by the audio input 59 indicates that a baby in the baby carrier is crying or making another aural output, and adjust operation of the force generator 18 accordingly, such as initiating and maintaining oscillation until the baby ceases to create an audial output, increasing the amplitude of oscillation, or terminating oscillation if the baby in the baby carrier 20 has ceased generating an audial output after a predetermined period of time.

The audio output 51 or sound generation device may comprise any audio output device such as a speaker, a transducer, or motors capable of producing audial outputs. Such devices may produce an alarm, calming noises, white/pink noises, womb noises, heartbeat sounds, motor noise, pre-recorded or recordable human voices, music, and/or the like. The audio output is configured to provide an aural output when a predetermined condition is achieved such as when a parameter is selected from the user interface, when power is applied, when a predetermined time period has elapsed, when a baby has begun to generate a stressful audial output such as a crying noise, or when the baby carrier is in motion. The volume of the audio output is adjustable by a user through the user interface or by the controller 50. The system may additionally comprise an adjustable light output to one or more of: assist with baby care, entertain baby, nightlight, and/or the like. Also, a timer may be coupled to the controller 50. The timer may communicate with the controller 50 to facilitate variable intensity over time or to record and/or adjust duration of use. The timer may also be implemented in hardware and/or software associated with or executed by the processor 52.

The controller 50 may be powered by an internal or external power source 63. This power source may be a DC power source, such as a battery. The battery may be collocated with the force generator 18 or it may be housed so that it is coupled to the system. Alternatively, an AC power source may be coupled to the system to apply power externally.

The data provided from the sensors 53 may be provided to the controller 50, such that the controller 50 may adjust operational parameters of the force generator 18 in response to the provided data and in a manner preset into the controller 50. Accordingly, the controller 50, when suitably programmed, may increase the range of motion of the container 20 and/or the force experienced by the elastic supporter 16, in response to an indication from the controller 50. The controller 50 may be manually reset or incremented to a new setting while the system is being used. If the user decides to increase the range of motion, for example, change the mode of operation from periodic, timed, sensor, or variable, the user need only enter an appropriate command via the controller 50.

The controller 50 also may comprise a mode control 64 and a timer control 65 accessible to a user through the user interface 57. In various embodiments, the user may control a period of time of operation of the baby rocking system or may specify different modes of operation such as a periodic start and stop mode, a sensor-based operational mode wherein the sensors or audio inputs may detect movement of the baby (such as a strain gauge or accelerometer detecting motion induced by a baby in the baby carrier 20) or crying of the baby and provide input to the processor 52 wherein a steps of a program executed by the processor 52 may cause a predetermined operational mode to be triggered, for instance, for the force generator 18 to begin applying an oscillatory force to rock the baby in the baby carrier 20.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for moving a provided baby container suspended above ground from a support structure, the system comprising:

a force generator configured to couple to the baby container, wherein the force generator comprises one or more motors and a plurality of gears coupled to the one or more motors and wherein a first of the plurality of gears includes a first weighted portion and a second of the plurality of gears includes a second weighted portion;

an elastic supporter having a first and a second end;

wherein:

the first end of the elastic supporter is coupled to the support structure;

the second end of the elastic supporter is coupled to the baby container via the force generator;

a resonant characteristic of the elastic support coupled to the baby container along with the force generator are configured to create a periodic force to the baby container in a vertical direction and oscillatory motion in the vertical direction, wherein the oscillatory motion provides a displacement of the provided baby container in an approximate range of between one and forty inches, inclusively.

2. The system of claim 1 wherein the elastic supporter comprises a plurality of linear elastic supporters.

3. The system of claim 1 wherein the force generator comprises a mass and a driver configured to move the mass.

4. The system of claim 1 wherein the one or more motors rotates the plurality of gears such that the first weighted portion is in phase with the second weighted portion at two times during one complete rotation of the first of the plurality of gears and the second of the plurality of gears, wherein a line extending from a first position of the first weighted portion when located at a first of the two times to a second position of the first weighted portion when located at a second of the two times is substantially parallel to a vector for the oscillating force.

5. The system of claim 1 wherein a resonant characteristic of the elastic support coupled to the force generator creates a periodic motion when the force generator coupled to the baby container applies periodic force to the baby container.

6. The system of claim 1 further comprising a controller for controlling the force generator.

7. The system of claim 6 wherein the controller comprises at least one of a, sensor, processor, display, intensity control, audio control, power inputs, user interface, light output, an audio input, video input, a data interface, and a memory card interface.

8. The system of claim 7 wherein the sensor further comprises at least of a potentiometer, tilt switch, pressure switch, strain gauge, material motion detector, linear variable differential transformer, and accelerometer configured to detect motion.

9. The system of claim 7 wherein the processor is configured to interpret instructions and execute programs stored in a memory.

10. The system of claim 7 wherein the display further comprises at least one of a reference marking, colored light, computer monitor, remote handheld device, electroluminescent display (ELDS), light emitting diode (LED) display, liquid crystal display (LCD), active-matrix thin-film twisted nematic and metal-insulated-metal twisted nematic (TFT-TN and MIM-TN) displays configured to at least one of entertain, display indicia or provide information.

11. The system of claim 7 wherein the audio input further comprises a microphone.

12. The system of claim 7 wherein the data interface further comprises interface between the controller and other computers and peripheral devices consisting of at least one of USB port, ethernet port, serial port, parallel port, IEEE 1394 interface, wireless antenna, Wi-Fi, mini-DIN connector, D-sub 15, DVI, RCA connectors and transceiver microchips.

13. The system of claim 7 wherein the controller is further configured to transmit audio/video information.

14. The system of claim 13 wherein the audio/video information may be transmitted via at least one of digital transmission and analog transmission

15. The system of claim 7 wherein the memory card interface is configured to couple to at least one of a solid-state flash memory data storage device a PC card, a PCMCIA card, a CompactFlash card, a memory stick, a flash drive, a miniSD card, a microSD card, a MMCmicro card, a Secure Digital Card, a memory stick, and SIM card.

16. The system of claim 6 wherein the predetermined condition comprises detection, by the controller, that at least one of the following events has occurred:

a sound is detected by a controller coupled to the force generator, the sound indicative of a baby crying;

a motion of the baby container is detected by a controller coupled to the force generator;

a power signal is received by a sound generation device proximate the force generator; and a human utterance has been recognized by a controller coupled to the force generator.

17. The system of claim 1 further comprising a sound generation device proximate the force generator wherein the sound generation device is configured to provide an aural output when a predetermined condition is achieved and wherein the sound generation device is configured to produce at least one of an alarm, a calming noise, a white noise, a womb noise, a heartbeat, a motor noise, a pre-recorded or recordable human voice, and music.

18. The system of claim 1 wherein an interfacing elastic member is disposed between and respectively coupled to the force generator and baby container.

19. The system of claim 1 wherein the provided baby container is configured to contain a baby in a vehicle.

20. The system of claim 1 wherein the force generator may be configured to control at least one of the speed, timing, period and amplitude of the motion.

21. A system for moving a provided baby container suspended above ground from a support structure, the system comprising:

a force generator configured to couple to the baby container, wherein the baby container comprises at least one of a baby basinet, a baby bouncer seat, a baby carriage, a car seat, a baby cradle, a baby crib, a baby jumper, a baby stroller, and a baby swing, wherein the force generator comprises one or more motors and a plurality of gears coupled to the one or more motors and wherein a first of the plurality of gears includes a first weighted portion and a second of the plurality of gears includes a second weighted portion;

an elastic supporter having a first end and a second end; and wherein:

the first end of the elastic supporter is coupled to the support structure;

the second end of the elastic supporter is coupled to the baby container via the force generator; and the force generator is configured to apply a periodic force to the baby container to cause oscillatory motion of the baby container in the vertical direction, wherein the oscillatory motion provides a displacement of the provided baby container in an approximate range of between one and forty inches, inclusively.

22. The system of claim 21 wherein the sensor further comprises at least of a potentiometer, tilt switch, pressure switch, strain gauge, material motion detector, linear variable differential transformer, and accelerometer configured to detect motion.

23. The system of claim 21 wherein the processor is configured to interpret instructions and execute programs stored in a memory.

24. The system of claim 21 wherein the display further comprises at least one of a reference marking, colored light, computer monitor, remote handheld device, electroluminescent display (ELDS), light emitting diode (LED) display, liquid crystal display (LCD), active-matrix thin-film twisted nematic and metal-insulated-metal twisted nematic (TFTTN and MIM-TN) displays configured to at least one of entertain, display indicia or provide information.

25. The system of claim 21 wherein the audio input further comprises a microphone.

26. The system of claim 21 wherein the data interface further comprises interface between the controller and other computers and peripheral devices consisting of at least one of USB port, ethernet port, serial port, parallel port, IEEE 1394 interface, wireless antenna, Wi-Fi, mini-DIN connector, D-sub 15, DVI, RCA connectors and transceiver microchips.

27. The system of claim 21 wherein the memory card interface is configured to couple to at least one of a solid-state flash memory data storage device further a PC card, a PCMCIA card, a CompactFlash card, a memory stick, a miniSD card, a microSD card, a MMCmicro card, a Secure Digital Card, a memory stick, and SIM card.

28. The system of claim 21 wherein the sound generation device is configured to produce at least one of an alarm, a calming noise, a white noise, a womb noise, a heartbeat, a motor noise, a pre-recorded or recordable human voice, and music.

29. The system of claim 21 wherein an interfacing elastic member is disposed between and respectively coupled to the force generator and baby container.

30. The system of claim 21 wherein the provided baby container is configured to contain a baby in a vehicle.

31. The system of claim 21 wherein the force generator may be configured to control at least one of the speed, timing, period and amplitude of the motion.

32. The system of claim 21 wherein the predetermined condition comprises detection, by the controller, that at least one of the following events has occurred:

a sound is detected by a controller coupled to the force generator, the sound indicative of a baby crying;

a motion of the baby carrier is detected by a controller coupled to the force generator;

a power signal is received by the sound generation device; and a human utterance has been recognized by a controller coupled to the force generator.

33. A system for moving a provided baby container suspended above ground from a support structure, the system consisting of:

a force generator configured to couple to the baby container;

an elastic supporter having a first end and a second end;

a sound generation device proximate the force generator; and wherein:

the first end of the elastic supporter is coupled to the support structure;

the second end of the elastic supporter is coupled to the force generator;

the force generator is configured to apply a periodic force to the baby container to cause oscillatory motion; and the sound generation device is configured to provide an aural output when a predetermined condition is achieved.

* * * * *